US005805121A

United States Patent [19]

Burgan et al.

[11] Patent Number: 5,805,121

[45] Date of Patent: Sep. 8, 1998

[54] LIQUID CRYSTAL DISPLAY AND TURN-OFF METHOD THEREFOR

[75] Inventors: John M. Burgan, N. Palm Beach; Jonathon D. Carr; Carlos A. Sanchez, both of Boynton Beach, all of Fla.

[73] Assignee: Motorola, Inc., Schaumburg, Ill.

[21] Appl. No.: 674,041

[22] Filed: Jul. 1, 1996

[51] Int. Cl.[6] ..... G09G 3/18

[52] U.S. Cl. ..... 345/51; 345/52; 345/211

[58] Field of Search ..... 345/50, 51, 52, 345/94, 95, 96, 103, 211; 396/292

[56] References Cited

U.S. PATENT DOCUMENTS

| | | | |
|---|---|---|---|
| 3,976,362 | 8/1976 | Kawakami | 345/95 |
| 4,527,096 | 7/1985 | Kindlmann . | |
| 4,764,766 | 8/1988 | Aoyama et al. | 345/50 |
| 5,218,352 | 6/1993 | Endoh et al. | 345/50 |
| 5,218,399 | 6/1993 | Izumi et al. | 396/292 |

*Primary Examiner*—Steven J. Saras
*Assistant Examiner*—David L. Lewis
*Attorney, Agent, or Firm*—John H. Moore

[57] ABSTRACT

In a liquid crystal display (16) having rows and columns of pixels (22), one or more selected rows of pixels are turned off (put in a standby mode) in a manner that saves power. A row of pixels is turned off by applying to the row a cyclical two-level voltage (BP2) having a magnitude that, when combined with voltages (FP3) applied to columns, results in each pixel in the selected row receiving a combined voltage (BP2-FP3) having a reduced number of transitions (30), having a magnitude that is insufficient to turn on a pixel, and having an average value of substantially zero over a cycle. The method is incorporated in a liquid crystal display apparatus (32) having a mode control (54) for switching selected rows of pixels between an active mode and a standby mode.

7 Claims, 4 Drawing Sheets

LIQUID CRYSTAL DISPLAY AND TURN-OFF METHOD THEREFOR

FIELD OF THE INVENTION

This invention is directed to visual displays, and particularly to LCD's (Liquid Crystal Displays).

BACKGROUND OF THE INVENTION

LCD's are used in many battery powered products, including electronic calculators, selective call receivers such as pagers, and many other devices. A significant advantage of LCD's is their relatively low power consumption. This allows the products that they are used in to operate with a relatively long battery life, or with a very small battery.

The trend is toward even smaller and lighter products which consume less power. One way of saving power (and battery size and weight) in a product that uses an LCD is to turn off the drivers to all pixels that are in a standby condition or otherwise not being used. However, because of the way the pixels need to be driven, it is not practical to remove all power from them. LCD pixels need to receive a zero biased (average voltage equals zero) alternating current waveform, even if the pixels are off. If the applied wave form is not zero biased, the LCD can become polarized and non-functional. For this reason, LCD pixels are conventionally held in an off or standby condition by applying to them an alternating current waveform whose amplitude and resulting rms voltage are too small to turn them on.

A power consumption problem arises from the conventional type of LCD drive described above. Specifically, the alternating current waveform that is applied to pixels that are off has a relatively large number of abrupt voltage transitions. Each of these transitions consumes power. Hence, even when the pixels are in an off or standby condition, conventional LCD drive techniques consume excessive power. Accordingly, it is desirable to have an improved and lower power technique for establishing an off or standby mode for pixels in an LCD.

DESCRIPTION OF THE PREFERRED EMBODIMENT

Figure 1:
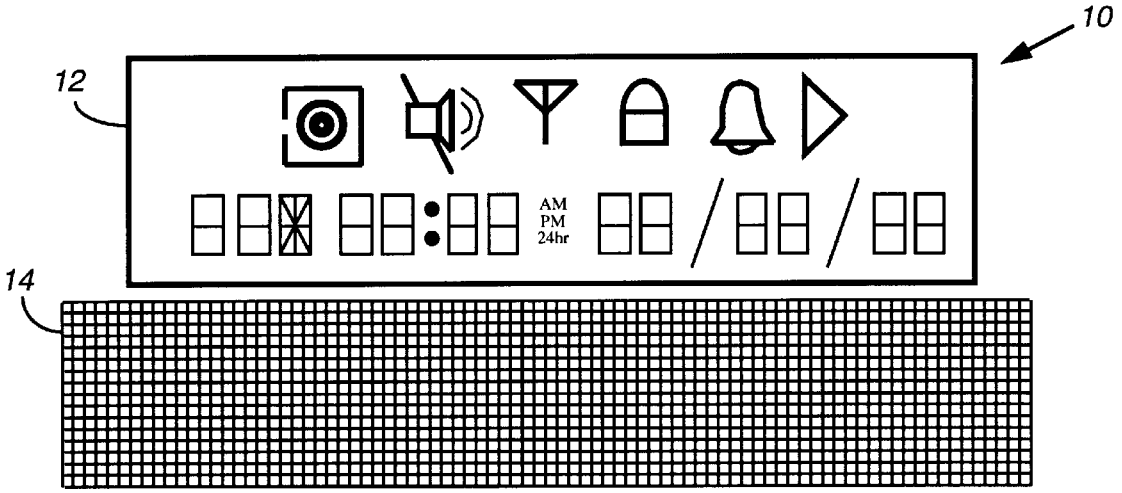
FIG. 1 Shows a conventional liquid crystal display.

Referring to FIG. 1, a typical LCD display 10 is shown. The illustrated display includes a first display section 12 and a second display section 14. The display 10 is the kind of display typically found in a selective call receiver such as a pager in which the first display section 12 includes various symbols which indicate the status of the receiver, the time of day, etc. The second display section 14 is used to display the text of messages which are received by the selective call receiver.

The display sections 12 and 14 are typically physically joined to each other to form a single, composite display that has sections 12 and 14 for displaying status and messages, respectively.

The display 10 includes a plurality of pixels or segments arranged in rows and columns. To drive the pixels, a plurality of row and column electrodes (not shown in FIG. 1) are coupled to the rows and columns, respectively of the pixels. Voltages applied to the row and column electrodes combine to create an electric field in the area between the electrodes. This area between electrodes is referred to as a pixel or segment, depending on the geometry of the area. Herein, the term "pixel" is used to refer to both pixel or segment. In any case, the voltages applied to the row and column electrodes combine to turn selected pixels on and other pixels off.

In order to reduce power consumption when the message section 14 is not in use, it would be desirable to shut off the drivers (not shown) that supply power to pixels in the message section 14. As discussed previously, however, it is necessary to apply an alternating current waveform having an average value of zero to the pixels that are not turned on. This avoids polarization and malfunction of the pixels, but it also wastes power when it is effected in the conventional manner.

This power consumption problem will now be discussed in more detail with reference to the small, two-section display 16 shown in FIG. 2. This display has a first status section 18 and a second message section 20. For purposes of simplifying the discussion, it is assumed that the section 20 is driven by three back plane electrodes BP1, BP2 and BP3, and six front plane electrodes FP1 through FP6. Herein, the back plane electrodes are sometimes referred to as row electrodes, and the front plane electrodes are sometimes referred to as column electrodes. The terms "row" and "column" are used to signify that the pixels are arranged in a matrix and are driven by pairs of electrodes. In some displays, these electrodes are referred to as "frontplane" and "backplane" electrodes; in other displays, they are called "segments" and "commons"; and in others they are referred to as "row" and "column" electrodes. Herein, the terms "row" and "column" electrodes are intended to refer to all such forms of electrodes, including those arranged in non-linear patterns. It should also be understood that the use of the terms "row" and "column" does not imply that a row extends either vertically or horizontally. Thus, "row " and "column" can be interchanged.

The front plane electrodes FP1–FP6 also drive the status section 18. However, the status section 18 has but a single back plane electrode BP4. It will be understood that the back plane (row) electrodes and the front plane (column) electrodes form a matrix, with a single pixel being located at the intersection of a row electrode and a column electrode. The voltage applied to a particular pixel is the combination of the voltages applied to the column and row electrodes which drive that particular pixel. Thus, in FIG. 2, a pixel 22 is turned on by the combination of voltages applied to FP4 and BP2; another pixel 24 is turned on by the combination of voltages applied to FP4 and BP4; and a third pixel 26 is turned on by the combination of voltages applied to FP2 and BP4. All other pixels in display 16 are off.

Figure 2:
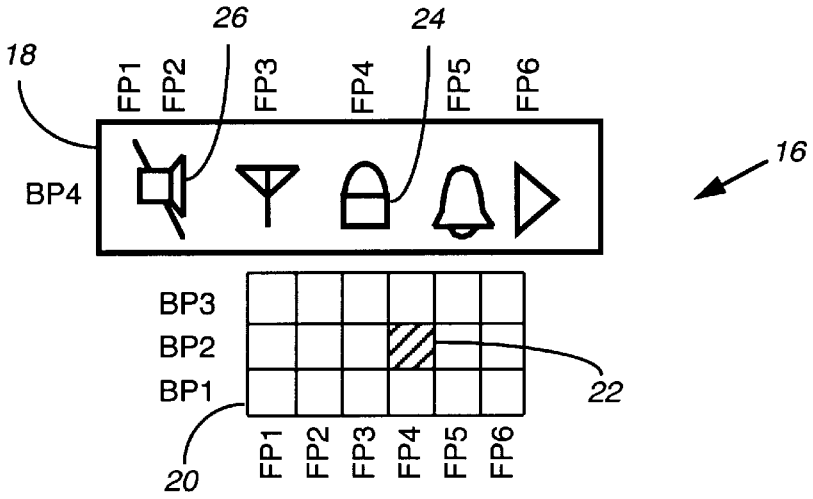
FIG. 2 illustrates another conventional liquid crystal display, including an indication of which front plane electrode and back plane electrodes are driven to turn on various pixels.
Figure 3:
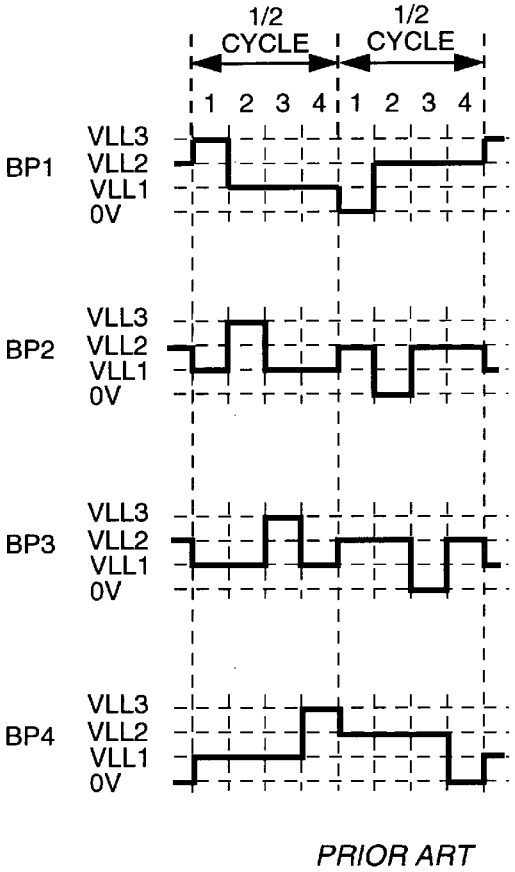
FIGS. 3 and 4 show conventional voltage waveforms that are applied to the electrodes of the liquid crystal display shown in FIG. 2.
Figure 4:
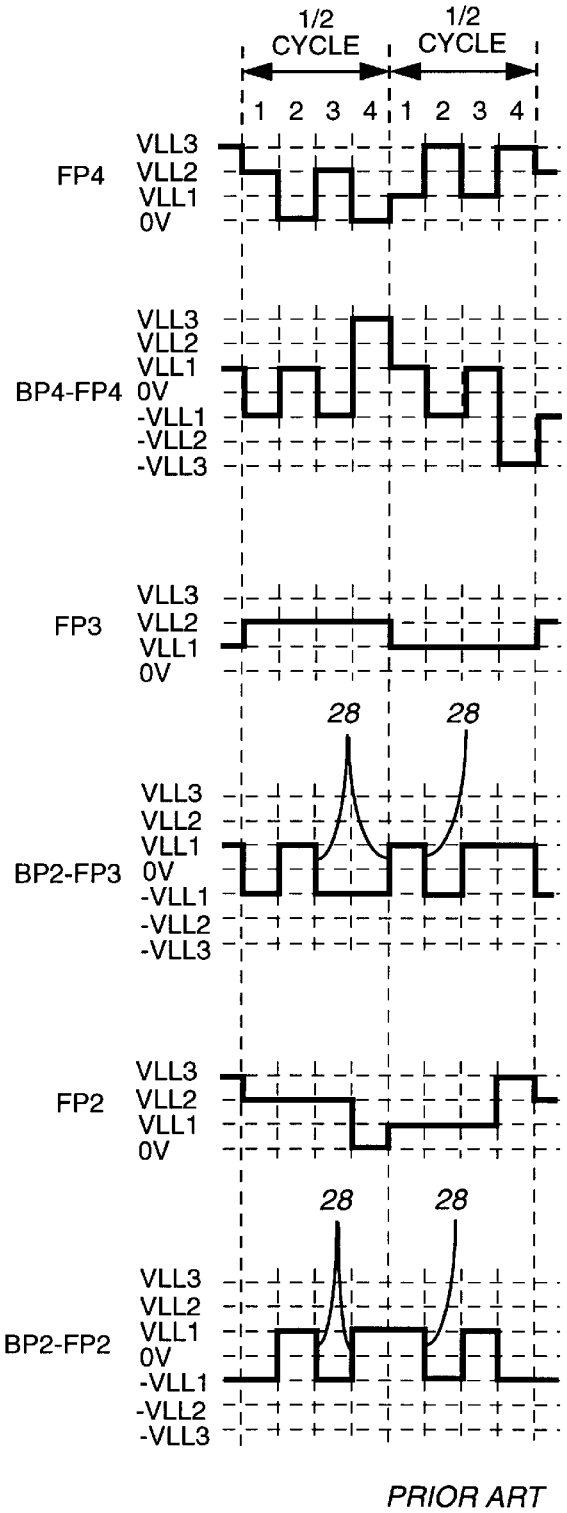

The conventional voltage waveforms that are applied to the display 16 are shown in FIGS. 3 and 4. Referring first to FIG. 3, waveforms BP1 through BP4 are shown. These are the voltage waveforms that are applied to the row electrodes BP1 through BP4 in FIG. 2.

Each of these waveforms can have up to four discrete voltage levels, 0 volts, VLL1, VLL2 and VLL3. The VLL3 and 0 volt levels are referred to herein as enabling levels, meaning that a pixel receiving such a level can be turned on by an appropriate turn-on voltage received from its corresponding column electrode. The other levels, VLL1 and VLL2 are not enabling.

Referring to waveform BP1, it undergoes steps 1, 2, 3 and 4 in its first half-cycle wherein it attains level VLL3 in step 1 and VLL1 in steps 2–4. In the second half-cycle, the waveform is essentially the inverse of the waveform during the first half-cycle. In step 1 of the second half-cycle, the BP1 voltage is 0 volts which is an enabling level. During steps 2–4, BP1 is at level VLL2 which is insufficient to enable turn-on. Thus, during the first half-cycle, row 1 is enabled by VLL3 in step 1, and during the second half-cycle row 1 is enabled by the level of 0 volts.

Referring to BP2, it reaches enabling levels VLL3 and 0 volts at steps 2 of its first and second half-cycles, respectively. Similarly, BP3 reaches VLL3 and 0 volts at steps 3 of its first and second half-cycles, respectively. The BP4 waveform reaches its enabling levels during steps 4 of its cycle. Thus, the row waveforms apply enabling potentials to rows 1–4 successively, during the first half-cycle, and then repeat this process during the second half-cycle, thereby enabling each row successively in order to permit one or more pixels in its row to be turned on, if desired, by an appropriate voltage on a column electrode. It should be noted that each row waveform includes all four voltage levels, 0 volts, through VLL3, irrespective of whether any pixel in the associated row is to be turned on.

Turning now to FIG. 4, column waveforms FP2, FP3 and FP4 are shown. (There is also an FP1 waveform which is not shown). These waveforms are applied to column electrodes FP2, FP3 and FP4 in FIG. 2. Also shown are three composite waveforms, BP4-FP4, BP2-FP3 and BP2-FP2. Each composite waveform results from the combination of a row waveform minus a column waveform, and it represents the actual voltage across a pixel.

Turning to waveform FP4, it can be seen that it also has two half-cycles that are the inverse of each other. VLL3 and 0 volts are the voltage levels that cause turn-on of a pixel when the corresponding row electrode provides an enabling voltage to the same pixel.

In steps 2 and 4 of FP4 (first half-cycle), the FP4 waveform is at 0 volts (turn-on) because it is desired to turn on pixels 22 and 24 (FIG. 2). In the second half-cycle, FP4 reaches VLL3 (turn-on) during step 2 and 4. The illustrated voltage levels that occur during steps 1 and 3 are insufficient to turn on a pixel.

The voltage across pixel 24 is shown as BP4-FP4. It is the difference between the row waveform BP4 and the column waveform FP4. Note that at step 4 in the first half-cycle the voltage reaches a peak of VLL3 plus VLL1. In the second half-cycle, the voltage at step 4 reaches a peak of −VLL3 −VLL1. This causes the pixel 24 to turn on during each half-cycle.

Because FP4 also reaches turn-on level during steps 2, the voltage BP2-FP4 (not shown) reaches turn on level during steps 2 and turns on the pixel 22.

Turning to waveform FP3, it can be seen that this waveform never reaches a turn-on level. Hence, no pixels in column 3 will be turned on. The voltage across one of the off pixels is shown as BP2-FP3. Even though this pixel is off, the voltage across it experiences many transitions 28. All such transitions consume power in the drivers that supply the waveform, even though the pixel in question is off.

Another example of unwanted power consumption can be seen by first examining waveform FP2. It attains a turn on level only during step 4, so that no pixel in rows 1–3 of column 2 is turned on. Examining the voltage across an off pixel in row 2, waveform BP2-FP2 again reveals multiple, power consuming transitions 28. Thus, if it is desired to turn off all pixels in the message section 20 when it is not being used, the conventional way of maintaining pixels in an off condition results in a large number of power consuming voltage transitions.

One possible way to eliminate the power consumed by the message section 20 is to completely separate the front planes and back planes used by the message section 20 from those used by the status section 18. This would allow the power to either section to be independently turned off, and all drive to the section to be turned off could then be discontinued. The drawback of this method is that it complicates the circuitry of the pixel drivers (two independent drivers must be included), and it increases the number of connections from the drivers to the display because the front planes would no longer be shared by the two sections of the display. Further, great care would be needed in routing the front plane and back plane connections from the drivers so that capacitive coupling did not occur between the section that was on and the section that was off. If any such coupling did occur, the display would become polarized and no longer function properly.

With this invention, a section of the display, or any selected row or rows of the display, is turned off in a manner that reduces the number of power consuming voltage transitions that occur in a row of pixels that are turned off. The display itself is not changed. Both sections, such as the message section 20 and the status section 18, share common column electrodes as in conventional displays. According to this method, selected pixels are turned on, and a selected row of pixels is turned off by applying, to row and column electrodes of the pixels to be turned on, voltages that combine to turn the pixels on in a conventional manner. For the selected row of pixels to be turned off, we apply to that row electrode a cyclical, two-level voltage having magnitudes that, when combined with voltages applied to the column electrodes, results in each pixel in the selected row receiving a voltage having an average value of substantially zero over a cycle, and having magnitudes that are insufficient to turn on any pixel in the selected row. The row voltage waveform that is applied to a row of pixels that is to be turned off (turn off waveform) is cyclical in the sense that is repeats without change from cycle to cycle so long as the row is to remain off.

Figure 5:
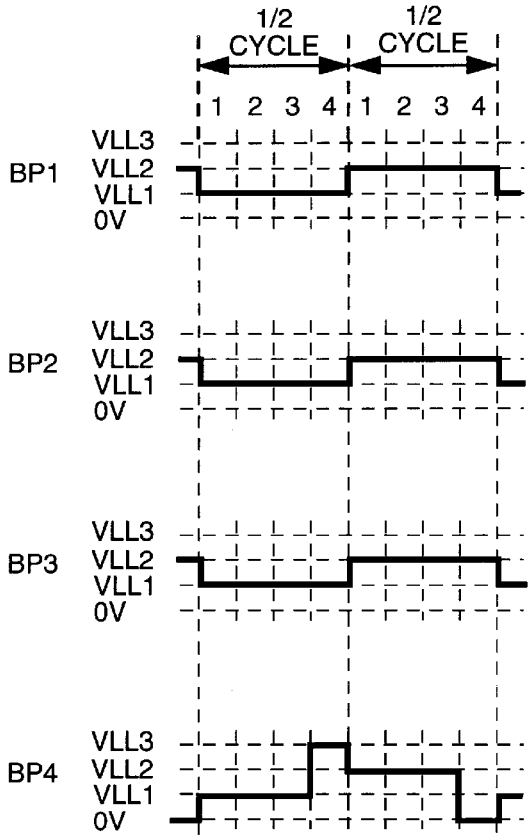
FIGS. 5 & 6 show voltage waveforms that are used to drive the display of FIG. 2 in accordance with the invention.
Figure 6:
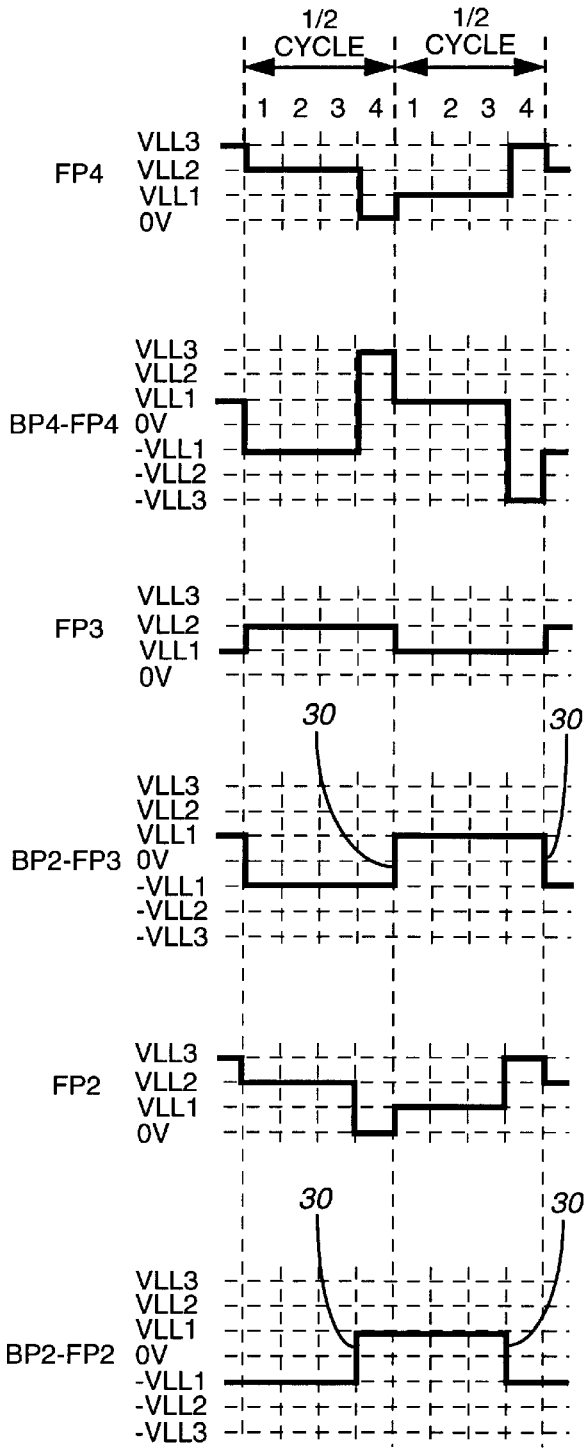

To turn off one or more selected rows of pixels, while simultaneously turning on other pixels, conventional column voltage waveforms are applied to the column electrodes, while the row voltage waveform is modified (for rows to be turned off). The waveforms that are preferably used to drive the display 16 in accordance with the invention are shown in FIGS. 5 and 6. Row waveforms BP1 through BP4 (FIG. 5) are applied to row electrodes BP1 through BP4 of FIG. 2. Exemplary column waveforms and combined row-column waveforms are shown is FIG. 6.

For purposes of illustration, we will assume that it is desired to turn off all pixels in the message section 20 and to maintain the status section 18 in an active state. Also, pixel 24 in status section 18 is to be turned on. Turning to FIG. 5, row waveform BP4 is conventional. It reaches an enabling level in each step 4 to allow any pixel in the status section 18 to be turned on by an appropriate column turn-on voltage. To turn on pixel 24, column waveform FP4 (FIG. 6) reaches a turn-on level of 0 volt in each step 4. As shown in waveform BP4-FP4, the combined voltage across pixel 24 reaches a turn-on level only during steps 4. It can be seen, therefore, that pixels in the active section of the display are turned on in the conventional manner that was discussed in connection with FIGS. 3 and 4.

Pixels in the message section 20 are turned off on a row by row basis. That is, any one row can be turned off, or any combination of rows can be turned off. When it is desired to turn off all three rows in the message section at the same time, a cyclical turn-off voltage waveform is applied to all rows driven by row waveforms BP1, BP2 and BP3.

Referring to waveform BP1, it is a cyclical, two-level voltage having a single voltage level VLL1 during a first half-cycle, and a single voltage level VLL2 during a second half-cycle. The voltage levels VLL1 and VLL2 are selected such that when they are combined with voltages applied to the column electrodes, the result for each pixel in the row is a combined voltage having the following characteristics: its magnitude is insufficient to turn on a pixel; and the combined voltage waveform has an average value of substantially zero over a cycle.

The turn-off voltage waveforms BP2 and BP3 are preferably identical to BP1. Thus, each row to be turned off can have the same turn-off waveform that includes two discrete voltage levels such as VLL1 and VLL2.

The effect of the row turn-off waveforms can be seen by first considering column waveform FP2. It reaches a single turn-on level in steps 4 to turn on part of pixel 26 in the status section 18. The effect on a pixel in row BP2 can be seen from the combined waveform BP2-FP2 whose magnitude never reaches turn-on level. The same kind of waveform exists for all pixels in a row that receive the BP2 waveform in FIG. 5.

Significantly, the BP2-FP2 waveform has only two voltage transitions 30. Compare this result with the BP2-FP2 waveform shown in FIG. 4 which has six transitions 28 when conventional drive techniques are employed. Note further that the BP2-FP2 waveform of FIG. 6 has an average value of zero, or substantially zero, over a full cycle. During its first cycle, it has a value of −VLL1 in steps 1, 2 and 3, and a value of +VLL1 in step 4. In its second half-cycle, it has a value of +VLL1 in steps 1, 2 and 3, and a value of −VLL1 in step 4. The average voltage over the complete cycle is zero. Thus, polarization of the display is avoided, while simultaneously saving power.

Consider waveform FP3. It never attains turn-on level because no pixels in the corresponding column are to be turned on. The voltage across a pixel at the intersection of the FP3 and BP2 waveforms is shown as BP2-FP3. This voltage also never attains turn-on level. Like the waveform BP2-FP2, it has an average value of zero and it has only two transitions 30 compared to six transitions 28 for the corresponding voltage shown in FIG. 4. By removing four of the six transitions, a 60% power saving is attained for each inactive pixel. By turning off all pixels in the message section 20 in this way, the standby power of the display 16 can be reduced by about 45%. Even greater power savings are available for larger displays. For example, in a display with 34 row electrodes, 32 of which can be put in a standby mode, the number of transitions experienced by each pixel can be reduced from 16 to 2. This results in a total power reduction of about 82%.

One can use this invention to switch a display from an active mode of operation (all pixels active) to a low power mode wherein one or more rows of pixels are put in the standby mode (turned off) in the manner described above. Such switching can be achieved through software or hardware, and automatically if desired. If software is used, one sets a bit in a register that controls the display's drivers. The set bit is arranged to cause the display to go into the low power or standby mode wherein certain pixels are turned off using the row turnoff waveform described above.

Figure 7:
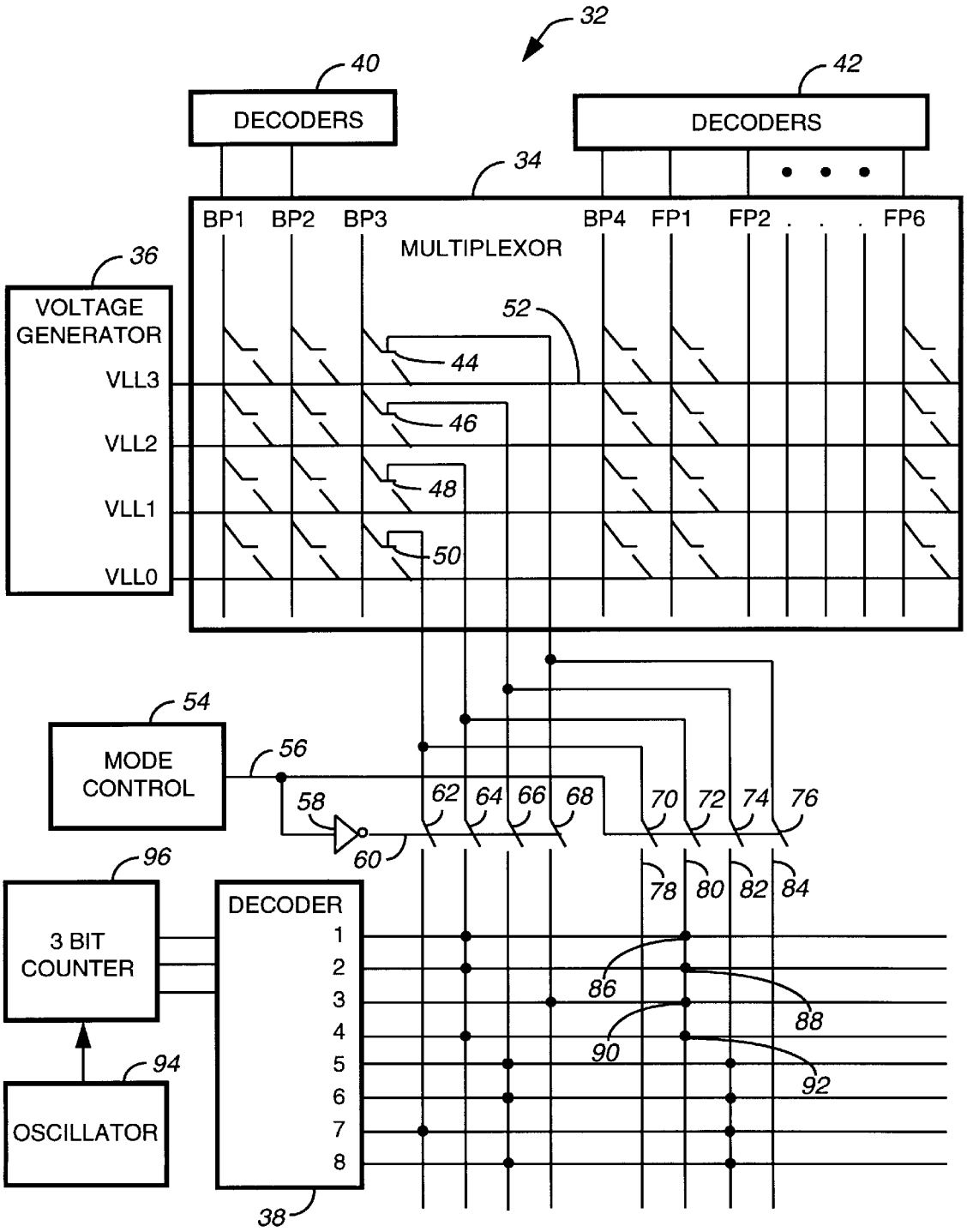
FIG. 7 is a schematic diagram of circuitry for driving the display of FIG. 2 with the waveforms shown in FIGS. 5 & 6, and for switching pixels from a standby mode to an active mode of operation in accordance with the invention.

This switch from an active mode of operation to a low power mode can be made, in accordance with another aspect of the invention, as illustrated in FIG. 7. What is shown is circuitry 32 for placing pixels in a standby mode as described previously, and for switching from the standby mode to an active mode of operation.

The illustrated circuitry 32 is for a display such as the one shown in FIG. 2 wherein the display has four row electrodes BP1 through BP4, and six column electrodes FP1 through FP6. Circuitry 32 is shown in simplified form in which it is conditioned to switch pixels in row three (electrode BP3) between the standby mode and the active mode.

Included in circuitry 32 is a conventional multiplexor 34 which has row electrodes BP1–BP4 and column electrodes FP1–FP6. The multiplexor 34 receives voltages VLL0 (corresponds to 0V in FIGS. 3–6), VLL1, VLL2 and VLL3 from a conventional voltage generator 36, and applies those voltages to the electrodes BP1–BP4 and FP1–FP6 in accordance with the output of conventional decoders 38, 40 and 42. The way in which the row electrode BP3 is driven by the decoder 38 is shown in detail and is discussed immediately below. It should be understood that decoders 40 and 42 operate in the same manner as the decoder 38 and drive electrodes BP1, BP2, BP4 and FP1–FP6 in a similar manner.

Referring now to the row electrode BP3, it is coupled to switches (e.g., transistor switches) 44, 46, 48 and 50, all of which are shown in an open position. When the switch 44 is closed, it couples the row electrode BP3 to a lead 52 which carries the voltage VLL3 from the voltage generator 36. Similarly, switches 46, 48 and 50 can couple electrode BP3 to voltages VLL2, VLL1 and VLL0, respectively. These voltages are coupled to electrode BP3 in accordance with connections between the switches 44–50 and the decoder 38, and also in accordance with the output of a mode control 54. The output of the mode control 54 determines whether pixels driven by electrode BP3 are in the active mode or in the standby mode.

The mode control is a conventional circuit for developing a high output when the standby mode is desired, and a low output when the active mode is desired. Assume that the mode control 54 is developing a high output on lead 56. That high output is coupled to an inverter 58 which develops a low output on lead 60. Lead 60 is coupled to switches 62–68 which are held in their illustrated open positions by the low output from the inverter 58.

The high output on lead 56 is coupled to additional switches 70–76, all of which become closed in response to the high output on lead 56. Closure of the switch 70 couples row electrode BP3 (when switch 50 is closed) to another lead 78. Similarly, closure of switches 72–76 makes it possible to couple row electrode BP3 to leads 80, 82 and 84. It can be seen that the lead 80 is connected at nodes 86, 88, 90 and 92 to outputs 1,2,3 and 4, respectively, from the decoder 38. The lead 82 is likewise connected to outputs 5,6,7 and 8 from the decoder 38. The decoder 38 generates, at its outputs 1–8, eight sequential control signals that actuate closure of the switches 44–50. These control signals are applied to the switches 44–50 via switches 70–76 when the standby mode is selected, and via switches 62–68 when the active mode is selected.

To generate the control signals, a conventional oscillator 94 provides system timing, driving a conventional three bit counter 96. Outputs from the counter 96 are coupled to the inputs of the decoder 38 conventionally. The decoder 38, preferably a 3 to 8 decoder, generates the eight sequential control signals at it outputs 1–8. These eight outputs correspond to the eight steps in each cycle.

Assume now that the active mode is selected wherein the output of the mode control 54 is at a low level. In this condition, switches 70–76 remain open, and the inverter 58 generates a high level output that closes switches 62–68.

During the first half-cycle of operation, the decoder 38 generates four sequential high level output signals at its outputs 1, 2, 3 and 4, corresponding to steps 1, 2, 3 and 4. During the second half-cycle, the decoder 38 generates another four sequential high level output signals at its outputs 5, 6, 7 and 8. As will be shown, these eight sequential outputs cause the row electrode BP3 to be actively driven as shown in FIG. 3.

When output 1 from decoder 38 goes high, switch 64 (now closed) couples this high output to switch 48 which responds by closing. Consequently, row electrode BP3 becomes coupled to VLL1 via closed switch 48. When output 2 goes high next, this holds switch 48 closed and again couples VLL1 to electrode BP3.

In step 3, output 3 from decoder 38 goes high, and this output is coupled through closed switch 68 to switch 44. Consequently, the switch 44 closes and couples electrode BP3 to VLL3. In the fourth step, the high level signal from output 4 is coupled through closed switch 64 to switch 48, again coupling BP3 to VLL1. This sequence of operations results in row electrode BP3 receiving a voltage waveform as shown in steps 1–4 of FIG. 3.

In the next half-cycle, outputs 5, 6, 7 and 8 from the decoder 38 cause voltages VLL2, VLL2 VLL0 and VLL2, respectively, to be applied to row electrode BP3, again as shown in FIG. 3. Thus, row electrode BP3 is actively scanned in a conventional manner when the mode control 54 is in its active mode. Any pixel in the row driven by BP3 can now be turned on by the proper turn-on voltage being applied to the corresponding column electrode.

When the standby mode is selected, the output of the mode control 54 goes high. This causes switches 62–68 to open, and switches 70–76 to close. As can be seen from the connections 86, 88, 90 and 92, the first 4 outputs from the decoder 38 become coupled through closed switch 72 to switch 48. Consequently, the switch 48 closes and couples electrode BP3 to VLL1 throughout steps 1–4 of the first half-cycle.

In the next half-cycle of operation, outputs 5, 6, 7 and 8 from decoder 38 are coupled via closed switch 74 to switch 46. Consequently, the switch 46 closes and couples electrode BP3 to VLL2 throughout steps 1–4 of the second half-cycle. In the standby mode, therefore, the operation of the mode control 54 results in row electrode BP3 receiving the turn-off waveform BP3 shown in FIG. 5. Hence, the voltage across each pixel in the row driven by waveform BP3 looks like BP2-FP2 (FIG. 6) or BP2-FP3 (FIG. 6). Only two voltage transitions are experienced by each such pixel, and their average voltage over a cycle is substantially equal to zero.

The invention may be used with LCD displays of various sizes to place one or more rows of pixels in the standby mode. Substantial power is saved when in the standby mode, and yet polarization of the pixels is avoided.

Although the invention has been described in terms of a preferred embodiment, it will be obvious to those skilled in the art that many alterations and modifications may be made without departing from the invention. Accordingly, it is intended that all such alterations and modifications be considered as within the spirit and scope of the invention as defined by the appended claims.

What is claimed is:

1. In a liquid crystal display having pixels arranged in rows and columns and coupled to corresponding row and column electrodes, wherein pixels in an active row are selectively turned on by a combination of voltages applied to the row and column electrodes, and wherein active rows are sequentially enabled once in a time period of one-half cycle, a method of turning on selected pixels in an active row and turning off a selected row of pixels, comprising:

applying, to row and column electrodes of the selected pixels, voltages that combine to turn on the selected pixels; and applying, to the row electrode for the selected row, a voltage having a first constant magnitude during a first half-cycle and a second, constant magnitude during a succeeding second half-cycle, the first and second magnitudes being selected such that, when combined with voltages applied to the column electrodes, each pixel in the selected row receives a combined voltage having an average value of substantially zero over a cycle, the combined voltage also having a magnitude that is insufficient to turn on a pixel.

2. A method as set forth in claim 1 wherein the voltage applied to the electrode of the selected row during the second half-cycle is the inverse of the voltage applied to the same electrode during the first half-cycle.

3. In a liquid crystal display having pixels arranged in rows and columns and coupled to corresponding row and column electrodes, wherein pixels in an active row are selectively turned on by a combination of voltages applied to the row and column electrodes, and wherein active rows are sequentially enabled once in a time period of one-half cycle, a method of turning off a selected row of pixels, comprising:

for pixels in the selected row, applying to their corresponding row electrode a cyclical voltage which has a first constant voltage level during a first one-half cycle and a second constant voltage level during a second one-half cycle, wherein the first and second constant voltage levels are selected such that when they are combined with voltages applied to the column electrodes, each pixel in the selected row receives a voltage having an average value of substantially zero over a cycle, and a magnitude that is insufficient to turn on a pixel.

4. In a liquid crystal display having pixels arranged in rows and columns and coupled to corresponding row and column electrodes, wherein the row and column electrodes receive voltages that combine to turn on selected pixels in an active row, wherein active rows are sequentially enabled once in a time period of one-half cycle, and wherein a number of voltage transitions are created when a pixel in an inactive row receives different consecutive combined voltages, a method of turning off a selected row of pixels, comprising:

applying to the row electrode of the selected row a turn-off voltage waveform which, in each full cycle, has a fixed number of discrete voltage levels, the fixed number and magnitude of discrete voltage levels being selected such that when the turn-off voltage waveform combines with voltages applied to column electrodes, a resulting voltage waveform across each pixel in the selected row has fewer than said number of voltage transitions in each full cycle, has an average value of substantially zero over a cycle, and turns off each pixel in the selected row.

5. A liquid crystal display apparatus, comprising:

a first display section having a plurality of pixels arranged in rows and columns;

a second display section having a plurality of pixels arranged in rows and columns, wherein a row having at least one pixel to be activated is an active row, and wherein active rows are sequentially enabled once in a time period of one-half cycle;

a plurality of row electrodes, one coupled to each row of pixels;

a plurality of column electrodes, one coupled to each column of pixels;

a voltage generator supplying a plurality of drive voltages;

circuitry for coupling selected drive voltages to the row and column electrodes for sequentially enabling the active rows once in a time period of one-half cycle, and for turning on selected pixels in active rows; and a mode control for selectively removing the selected drive voltages from the row electrodes of the first display section, and for coupling, to the row electrodes of the first display section, different drive voltages selected to turn off all pixels in the first display section, said different drive voltages having a first constant magnitude during a first one-half cycle and a second constant magnitude during a succeeding second one-half cycle.

6. Apparatus as set forth in claim 5 wherein the different drive voltages that are coupled to the row electrodes of the first display section during the second half-cycle are the inverse of the drive voltages applied to the same electrodes during the first half cycle.

7. Apparatus as set forth in claim 5 wherein the different drive voltages form a cyclical waveform having first and second discrete voltage levels selected such that, when they combine with voltages applied to the column electrodes, each pixel in the first display section receives a combined voltage waveform having an average value of substantially zero over a cycle.

* * * * *